US006982738B2

(12) United States Patent
Mogi

(10) Patent No.: US 6,982,738 B2
(45) Date of Patent: Jan. 3, 2006

(54) COLOR PRINTER AND COLOR PRINTING METHOD

(75) Inventor: Shusuke Mogi, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 94 days.

(21) Appl. No.: 10/782,860

(22) Filed: Feb. 23, 2004

(65) Prior Publication Data

US 2004/0189782 A1 Sep. 30, 2004

(30) Foreign Application Priority Data

Mar. 31, 2003 (JP) ..... 2003-093622

(51) Int. Cl.
*B41J 29/38* (2006.01)
*B41J 11/42* (2006.01)

(52) U.S. Cl. ..... 347/218; 400/582

(58) Field of Classification Search ..... 347/218, 347/172–176; 400/582–583, 120.02, 120.03, 400/120.04

See application file for complete search history.

(56) References Cited

U.S. PATENT DOCUMENTS 6,154,241 A 11/2000 Matsukawa et al.
2004/0189784 A1 * 9/2004 Mogi ..... 347/218

FOREIGN PATENT DOCUMENTS

JP 2000-168114 A 6/2000

* cited by examiner

*Primary Examiner*—Huan Tran
(74) *Attorney, Agent, or Firm*—Sughrue Mion, PLLC

(57) ABSTRACT

In the first print sequence, recording paper is conveyed in a printing direction. When the recording paper is conveyed to a target conveyance amount during the conveyance, a yellow image is printed. Then, the return sequence is performed. While conveying the recording paper in a supplying direction, ultraviolet rays is irradiated on the recording paper to fix a yellow image. During the fixing operation, the recording paper is returned by additionally considering the correction amount of conveyance according to the conveyance speed. In the return sequence, the recording paper is conveyed to the target conveyance amount to print a magenta image. Then the magenta image is fixed in the second return sequence. The recording paper is set in consideration of the conveyance speed during fixing the magenta image. After that, a cyan image is printed. Consequently, the printing position of each primary color becomes coincident.

10 Claims, 7 Drawing Sheets

COLOR PRINTER AND COLOR PRINTING METHOD

BACKGROUND OF THE INVENTION

1. Field of the Invention

The present invention relates to a color printer and color printing method that print a color image on a recording paper by three-color frame sequential printing, in particular relates to a color printer and color printing method that can prevent failure in registering due to a change of conveyance speed of the recording paper.

2. Explanations of the Prior Arts

A color thermal printer is generally known as a kind of color printer. The color thermal printer makes a thermal head heat the recording paper to print a color image. Instead of a cut sheet, a roll paper in which the recording paper is rolled tends to be used in the color thermal printer. The color thermal printer has two types, which are a one-head three-pass printer and a three-head one-pass printer. In the one-head three-pass printer, the recording paper is unwound from a paper roll and rewound thereto alternately. For instance, a single thermal head sequentially records a yellow image, a magenta image, and a cyan image while the recording paper is rewound for three times. Such a color thermal printer has some advantages that the print size is suitably changed in a longitudinal direction of the recording paper as well as reducing the size of the color thermal printer. In the three-head one-pass printer, on the other hand, three thermal heads are arranged at predetermined intervals. Each thermal head records each one of the three primary color images respectively while the recording paper is being supplied from the roll paper.

The front end of the recording paper is pulled from the roll paper by a supply roller that contacts the periphery of the roll paper. After the end of the recording paper is pulled, the recording paper is nipped by feed roller pair, which consists of a capstan roller and a pinch roller, and conveyed in a wind direction and a rewind direction of the recording paper. While the recording paper is being conveyed in the rewind direction, the thermal head heats the recording paper to record one of the three primary color images within a recording area of the recording paper (U.S. Pat. No. 6,154,241 corresponding to JPA No.2000-168114, for instance).

The printing area may be stretched and compressed due to heat of the thermal head. In addition, the fricative force to the feed roller pair may change according to the content of the color image printed within the printing area. This changes the conveyance amount slightly while the printing area of the recording paper is being in contact with the feed roller pair. As a result, uneven density and color registering failure occurs on the printed color image, to cause deterioration of image quality.

In order to cope with failure in registering, measures to prevent heat fluctuation are taken. However, the color registering failure still occurs in spite of this to require actions to take.

SUMMARY OF THE INVENTION

An object of the present invention is to prevent color registering failure caused by a change of the conveyance amount of a recording paper.

Another object of the present invention is to prevent color registering failure from being occurred easily.

As a result of investigation why color registering failure has occurred, they found that it is due to a change of speed to convey the recording paper. According to a color printer, since a length detecting counter counts a drive pulse of a convey motor to detect the position of the recording paper, as the starting edge of a printing area, the printing start position must be essentially coincident for each color. However, the conveyance amount changes slightly for one pulse because of a change of conveyance speed of the recording paper, such that just counting the drive pulse causes deviation. In the present invention, the correction amount caused as a change of conveyance speed is estimated. Then, the printing start position of a single primary color image to print is adjusted according to the correction amount of conveyance so as to prevent color registering failure.

The color printer of the present invention has a recording head that sequentially records the first to third primary color images within the printing area of the recording paper, a detector that detects the conveyance amount of the recording paper conveyed by the feed roller pair, a controller that performs a print sequence and a return sequence for each primary color image, and a correction means that estimates the correction amount of conveyance. In the print sequence, the recording paper is conveyed in a first direction by the feed roller pair. Furthermore, when the conveyance amount to the first direction after the start of conveyance reaches the first target conveyance amount, the recording head starts recording one of the first to third primary color images to the printing area. In the return sequence, on the other hand, the recording paper is conveyed in a second direction by the feed roller pair. Furthermore, when the conveyance amount to the second direction after the start of conveyance reaches the second target conveyance amount, conveyance of the recording paper is stopped. The correction means estimates the correction amount of conveyance according to the conveyance speed of the recording paper in the return sequence. And the correction means corrects the first and the second target conveyance amount in order to record the second and the third primary color images.

The recording paper has a cyan thermal coloring layer, a magenta thermal coloring layer, a yellow thermal coloring layer and a transparent protective layer that are laid on a substrate in the order listed. Irradiance from the fixing device fixes the magenta thermal coloring layer and the yellow thermal coloring layer during the return sequence. The intensity of irradiance is measured by an irradiance measuring device according to irradiance. The controller controls the conveyance speed in the return sequence. Based on the conveyance speed, the controller estimates the correction amount of conveyance to correct the second target conveyance amount.

In the further preferred embodiment of the present invention, the conveyance speed is set at a constant in the print sequence. However, the conveyance speed is sequentially changed in the return sequence so as to keep electromagnetic irradiance at a regular amount. Plural levels of the correction amount to the fluctuation of the conveyance speed are accumulated to obtain the correction amount of conveyance.

In the color printing method of the present invention, the color printer starts printing when the conveyance amount from the start of conveyance reaches the first target conveyance amount in the middle of conveyance of the recording paper in the first direction. After the first to third primary color images are recorded within the printing area, the recording paper is conveyed in the second direction. The color printer stops conveyance when the conveyance amount from the start of conveyance reaches the second target conveyance amount in the middle of conveyance of the recording paper in the second direction. The correction amount of conveyance is estimated based on the conveyance speed while the recording paper is being conveyed in the second direction. In order to record the second and third primary color images, the first and the second target conveyance amount are respectively corrected in accordance with the correction amount of conveyance.

According to the present invention, fluctuation of the conveyance amount is adjusted as the conveyance speed changes. Owing to this, the recording position of each primary color becomes coincident to prevent color registering failure. The degree of fluctuation of the conveyance amount is easily estimated from the conveyance speed.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
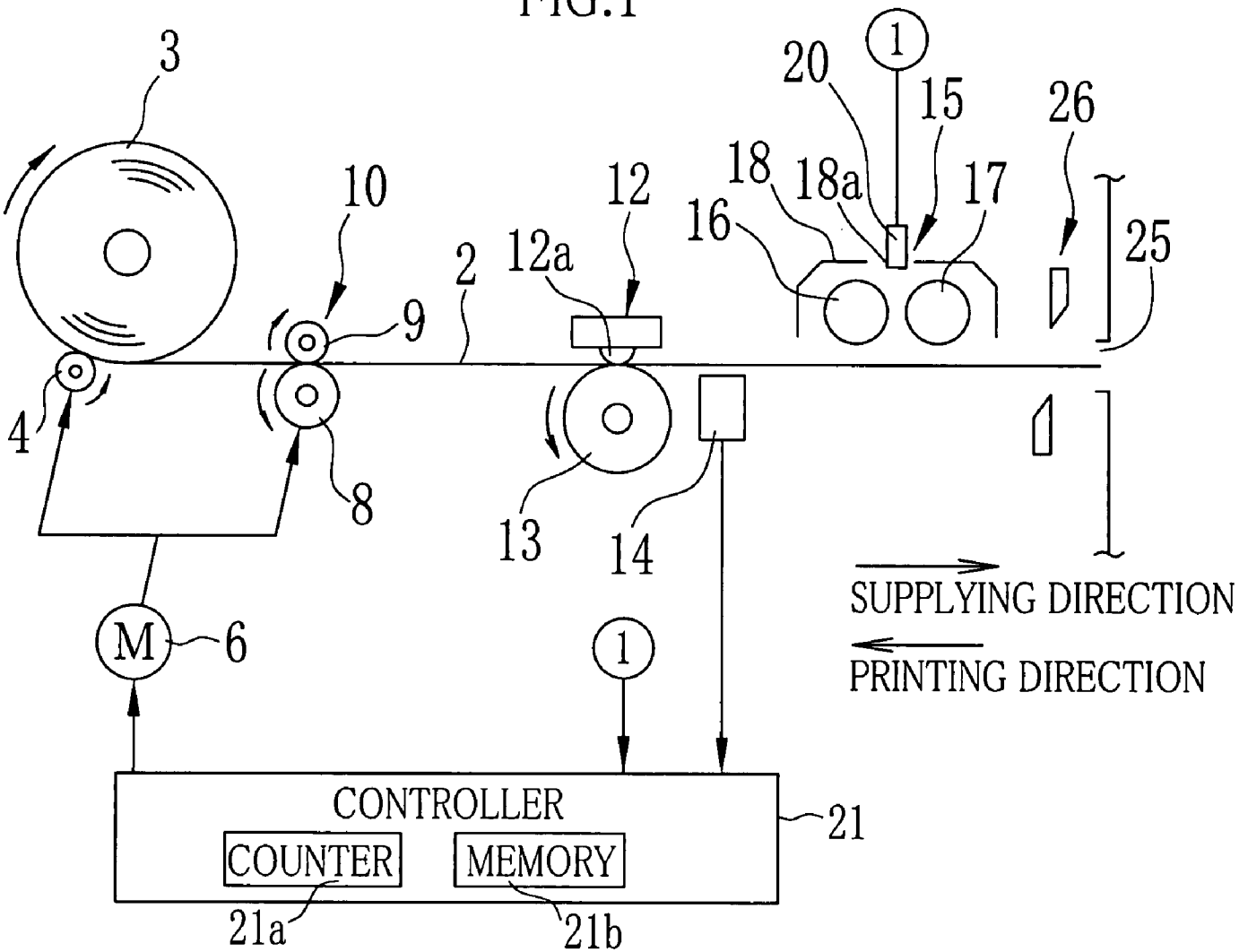
FIG. 1 is a perspective view illustrating structure of a color thermal printer of the present invention.

In FIG. 1, a continuous color thermal recording paper 2 (referred to as a recording paper hereafter) is used for a color thermal printer. The recording paper 2 is rolled as a roll paper 3 to be set to the color thermal printer. The periphery of the roll paper 3 contacts the supply roller 4 which is rotated by a pulse motor 6. When the supply roller 4 rotates clockwise in the drawing, the roll paper 3 is rotated counterclockwise to pull a front end of the recording paper 2 from the roll paper 3. When the supply roller 4 rotates counterclockwise, on the other hand, the roll paper 3 is rotated clockwise to wind the recording paper 2 around the periphery of the roll paper 3.

The supply roller 4 is movable in a direction to contact the roll paper 3 and urged towards the roll paper 3 by a spring (not shown). The roll paper 3 always contacts the periphery of the supply roller 4, although the diameter of the roll paper 3 decreases with its usage. Therefore, it is possible to supply the recording paper 2 without fail. It is also possible to make the roll paper 3 movable towards the supply roller 4 instead of moving the supply roller 4.

Figure 2:
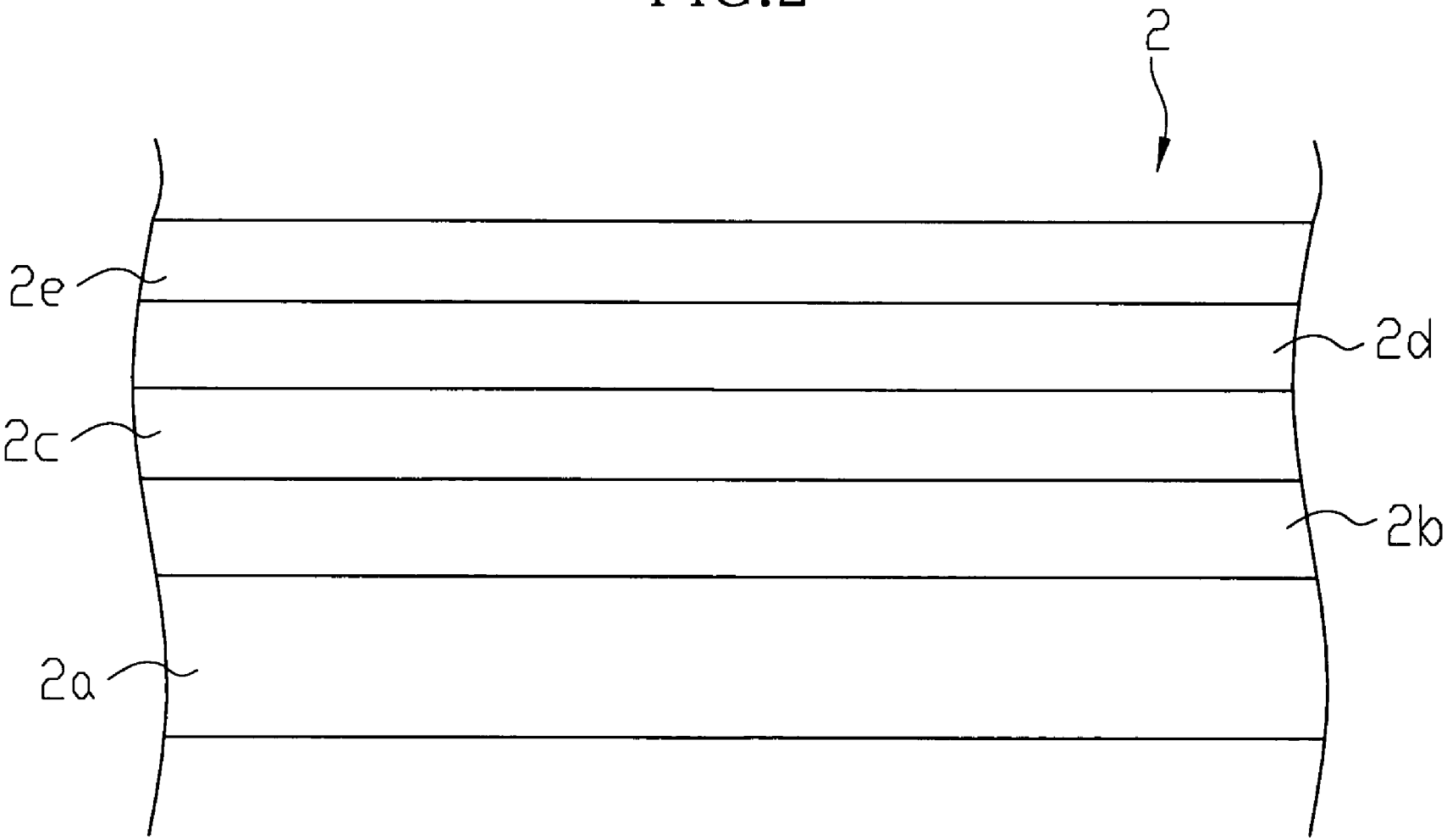
FIG. 2 is an explanatory view illustrating layer structure of a color thermal recording paper.

As shown in FIG. 2, the recording paper 2 has a cyan thermal coloring layer 2*b*, a magenta thermal coloring layer 2*c*, a yellow thermal coloring layer 2*d*, and a protective layer 2*e* that are laid on a support 2*a* in the order listed. The yellow thermal coloring layer 2*d*, the uppermost layer, has the highest thermosensitivity and develops yellow when small thermal energy is applied. Meanwhile, the cyan thermal coloring layer 2*b*, the lowermost layer, has the lowest thermosensitivity and develops cyan when large thermal energy is applied. The yellow thermal coloring layer 2*d* loses its coloring ability when visible violet rays with a wavelength whose peak value is 420 nm is emitted. The magenta thermal coloring layer 2*c* develops magenta when thermal energy between the levels for the yellow thermal coloring layer 2*d* and the cyan thermal coloring layer 2*b* is applied, and loses its coloring ability when near ultraviolet rays with a wavelength whose peak value is 365 nm is emitted. The cyan thermal coloring layer 2*b*, due to low thermosensitivity, neither develops cyan at a normal stored condition nor has a property for fixing. Otherwise, it is also possible to provide a black thermal coloring layer on the recording paper 2 to make the recording paper with four-layer structure, for instance.

Figure 3:
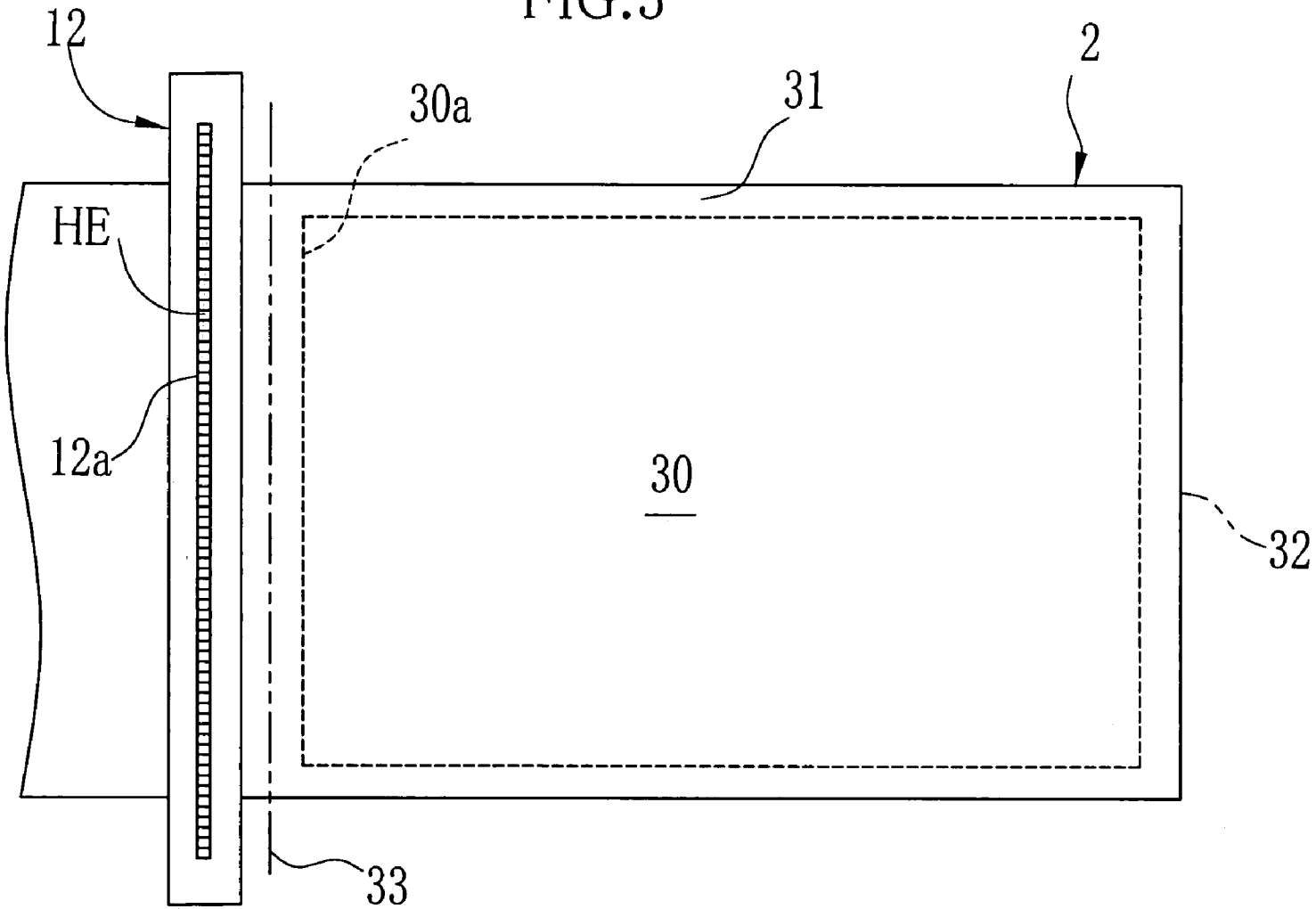
FIG. 3 is an explanatory view illustrating a thermal head and a printing area.

The width of the recording paper 2 is 130 mm, for instance. As shown in FIG. 3, three primary color images are sequentially recorded within a printing area 30 sectioned by dotted lines. The three primary color images are yellow, magenta, and cyan in this embodiment. The printing area 30, for example, is 127 mm in width and 89 mm in length. For instance, when the recording paper 2 is cut by a cut line 33 at a distance of 92 mm from the front end, a color print with a margin 31 around the printing area 30 is obtained.

A feed roller pair 10 to nip and convey the recording paper 2 is disposed on a downstream side of the supply roller 4. The feed roller pair 10 consists of a capstan roller 8 and a pinch roller 9. The capstan roller 8 is driven by the pulse motor 6. The pinch roller 9 is movable between the press direction to press the capstan roller 8 and the rest direction away from the capstan roller 8. And the pinch roller 9 is urged towards the capstan roller 8 by a spring (not shown). Upon supplying the recording paper 2, the pinch roller 9, resists the urge of the spring, is moved in the rest direction by a shift mechanism that is composed of a cam, a solenoid, and so forth.

The feed roller pair 10 conveys the recording paper 2 in a printing direction during the print sequence and conveys back in a supplying direction during the return sequence. Note that the supplying direction is a direction to convey the recording paper 2 toward a paper discharge path from the roll paper 3, while the printing direction is reverse to the supplying direction, namely to rewind the recording paper 2 into the roll paper 3. The printing direction is a first direction in contrast with the supplying direction as a second direction. A length detecting counter 21*a* disposed in a controller 21 counts the number of drive pulse of the pulse motor 6 as a detector to measure the conveyance amount of the recording paper 2. Otherwise, an encoder may be attached to the pinch roller 9 instead of the drive pulse, for counting the pulse number of the encoder.

A thermal head 12 as recording head is disposed on the downstream side of the feed roller pair 10. As shown in FIG. 3, the thermal head 12 has a heating element array 12*a* in which a large number of heating elements (HE) are arranged in a line across the feeding of the recording paper 2. Note that, the heating element array 12*a* is illustrated on the thermal head 12 in FIG. 3. A platen roller 13 is arranged so as to face the thermal head 12. The platen roller 13 is movable in a vertical direction and urged in a direction to press the thermal head 12 by a spring (not shown).

While the recording paper 2 is conveyed in the printing direction, each heating element (HE) of the heating element array 12*a* generates heat to the temperature corresponding to image data, for developing color of each thermal coloring layer within the printing area 30. The platen roller 13 follows to rotate because the recording paper 2 is conveyed. Upon supplying and ejecting the recording paper 2, the platen roller 13 is moved down by the shift mechanism, so that a gap to pass the recording paper 2 is formed between the thermal head 12 and the platen roller 13.

A fixing device 15 for emitting electromagnetic radiation with two types of wavelength ranges is disposed on the downstream side of the thermal head 12. The fixing device 15 consists of a yellow fixing lamp 16, a magenta fixing lamp 17, and a reflector 18 in this embodiment. The yellow fixing lamp 16 emits electromagnetic radiation (visible violet ray) whose radiation peak is 420 nm. The magenta fixing lamp 17 emits electromagnetic radiation (ultraviolet ray) whose radiation peak is 365 nm. These fixing lamps 16 and 17 do not develop their respective related colors even if the yellow thermal coloring layer 2*d* and the magenta thermal coloring layer 2*c* are re-heated.

An opening 18*a* is formed at the center of the reflector 18. And an irradiance sensor 20 as irradiance measuring device is arranged so as to face the opening 18*a*. The irradiance sensor 20 measures irradiance of the fixing lamps 16 and 17 respectively. A signal from the irradiance sensor 20 is emitted to the controller 21, which refers to the signal to control the conveyance speed of the recording paper 2. Consequently, the fixing amount is kept regularly.

An outlet 25 is provided on the downstream side of the fixing device 15. And a cutter 26 to cut the recording paper 2 into a sheet paper is disposed between the reflector 18 and the outlet 25. The printed printing area 30 is cut by the cutter 26 along a cutting line 33 (see FIG. 3), then ejected to be a color print through the outlet 25.

The controller 21 alternately commands the print sequence and the return sequence. In the print sequence, the controller 21 makes the thermal head 12 print the image of yellow, magenta, and cyan successively. In the return sequence, the images of yellow and magenta are fixed. Further, the controller 21 estimates the correction amount of conveyance in compliance with the conveyance speed of the recording paper 2 during the return sequence. Consequently, as the printing start position agrees with each color, color registering failure is prevented. Moreover, the controller 21 controls each section of the color printer.

Figure 4:
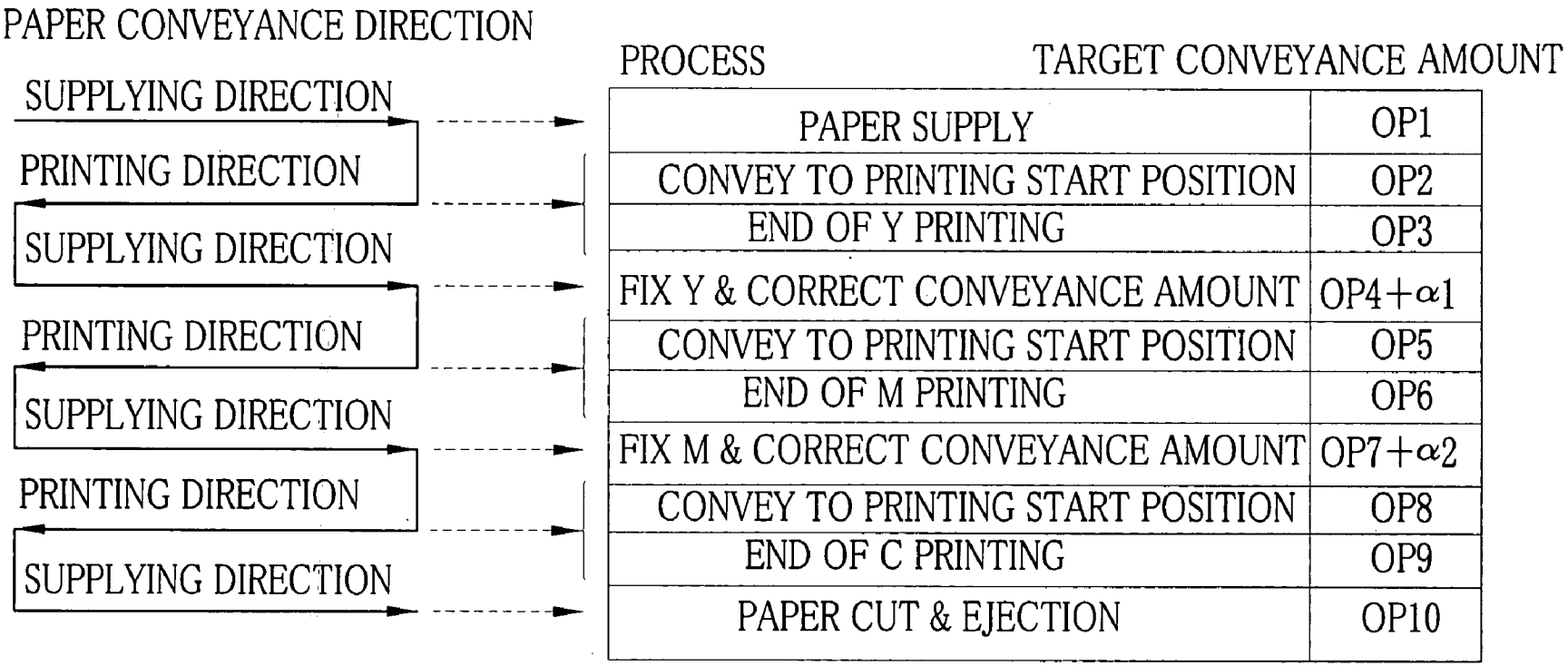
FIG. 4 is an explanatory view illustrating a conveyance direction of a recording paper and a target amount of conveyance in each process.
Figure 5:
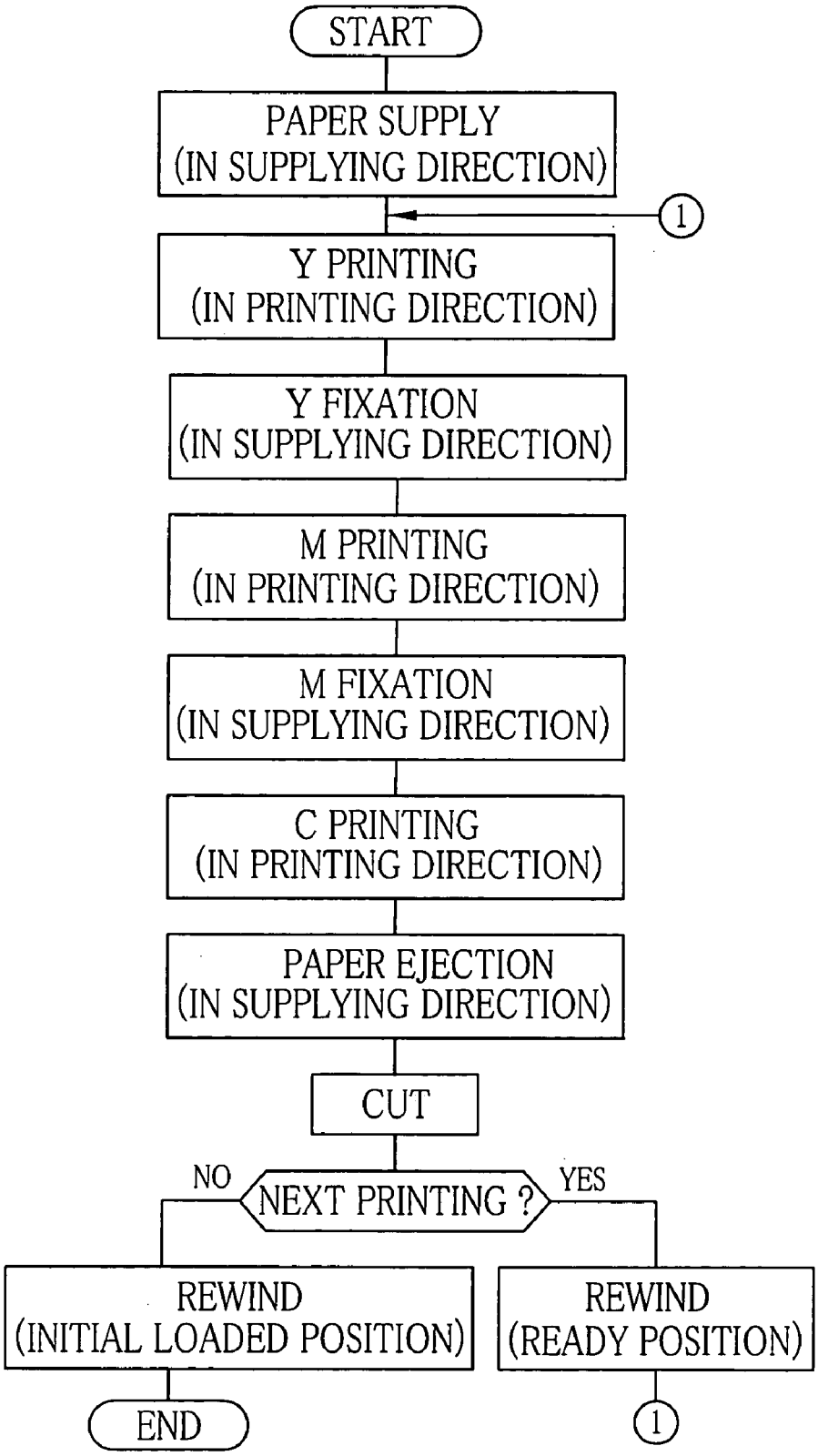
FIG. 5 is a flow chart illustrating the print process of the color thermal printer.
Figure 6:
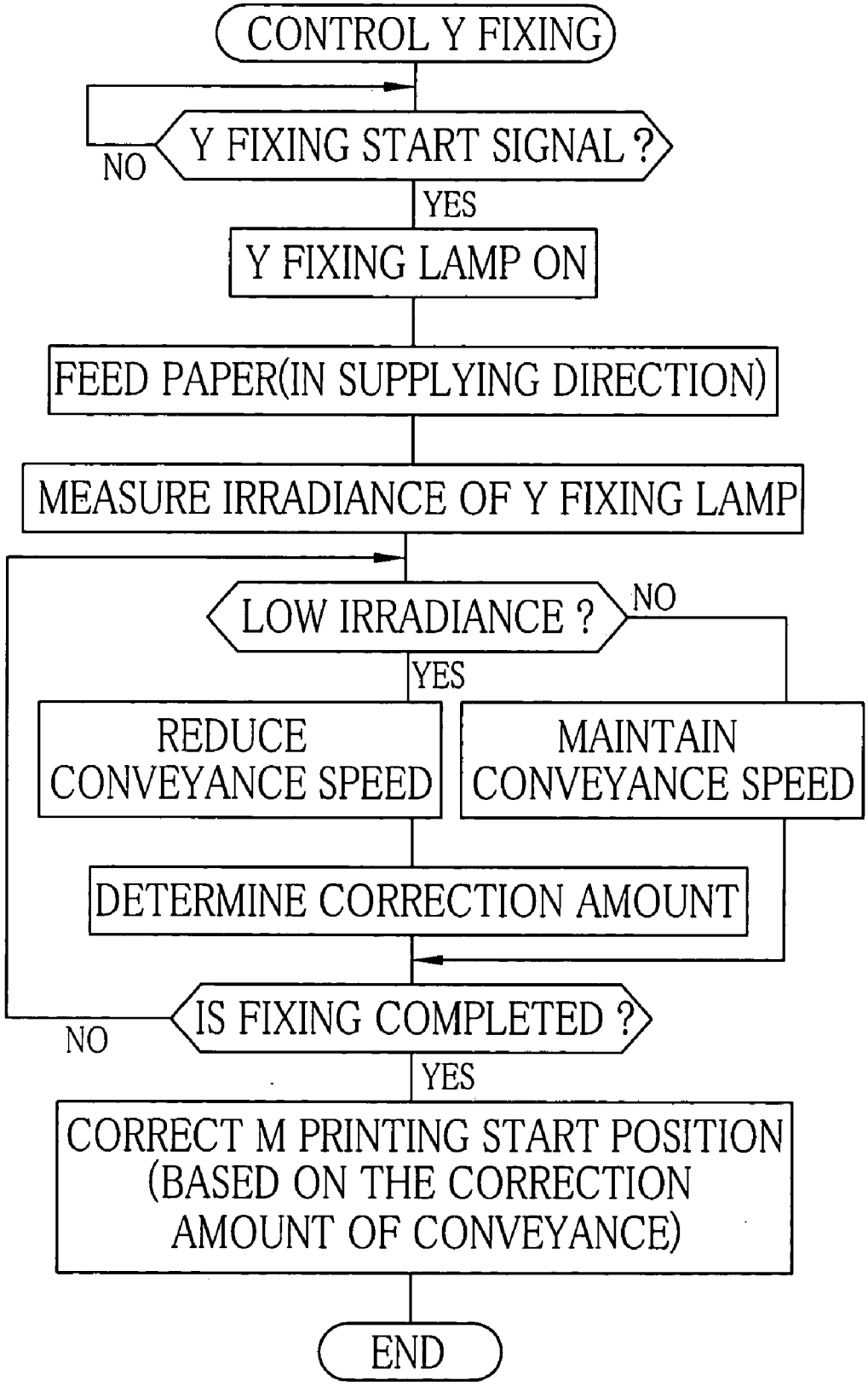
FIG. 6 is a flow chart illustrating an example in which the conveyance amount of the recording paper is controlled upon fixing yellow.

The operation of the above embodiment is mentioned in reference with FIGS. 4 and 6. In response to a print start command, the pulse motor 6 starts rotating. Rotation of the pulse motor 6 is transmitted to the supply roller 4 and the feed roller pair 10. Against the urge of the spring, the pinch roller 9 of the feed roller pair 10 is positioned away from the capstan roller 8 during supply of the recording paper 2. The platen roller 13 is also positioned away from the thermal head 12.

The supply roller 4 rotates to transport a front end 32 of the recording paper 2 out of the roll paper 3 and feeds it between the pinch roller 9 and the capstan roller 8 of the feed roller pair 10. The timing that the end 32 of the recording paper 2 passes through the feed roller pair 10 is detected from the number of drive pulse of the pulse motor 6. After the end 32 of the recording paper 2 passes through the feed roller pair 10, the shift mechanism is set free, making the spring lower the pinch roller 9 to nip the recording paper 2 with the capstan roller 8.

The capstan roller 8 rotates to transport the recording paper 2 towards the thermal head 12. A front end sensor 14 to detect the end 32 of the recording paper 2 is disposed on the downstream of the thermal head 12. Upon detecting the end 32 of the recording paper 2, the length detecting counter 21*a* of the controller 21 starts counting the drive pulse of the pulse motor 6. The count number of the length detecting counter 21*a* at the start of counting is set as "0". When the count number of the length detecting counter 21*a* reaches the target conveyance amount OP1, the pulse motor 6 stops to set the end 32 of the recording paper 2 at a regular ready position. The shift mechanism stops driving and the platen roller 13 is lifted by the urge of the spring, cooperating with the thermal head 12 to nip the recording paper 2.

The length detecting counter 21*a* counts the number of drive pulse of the pulse motor 6 in order to measure the conveyance amount of the recording paper 2 transported by the feed roller pair 10. Not only detecting the ready position (target conveyance amount OP1), the length detecting counter 21*a* detects the printing start position (target conveyance amount:OP2, OP5, OP8), the print completion position (target conveyance amount:OP3, OP6, OP9), the fix completion position (target conveyance amount:OP4, OP7), the cut position (target conveyance amount: OP10). Normally, the target conveyance amounts of OP2, OP5, and OP8 are the same. Similarly, the target conveyance amounts of OP3, OP6, and OP9, further the target conveyance amounts OP4 and OP7 are also the same respectively. And the target conveyance amount OP1 is the same as the target conveyance amount OP4.

The controller 21 performs the print sequence. The pulse motor 6 rotates reversely to rotate the feed roller pair 10 and the supply roller 4 in a reverse direction. Due to this, the recording paper 2 is transported in the printing direction. The controller 21 detects that a starting edge 30*a* of the printing area 30 reaches the thermal head 12 based on the count number of the drive pulse of the pulse motor 6. Namely, the length detecting counter 21*a* measures the conveyance amount from the start of backward rotation of the pulse motor 6. When the count number reaches the target conveyance amount OP2, the controller 21 judges that the starting edge 30*a* of the printing area 30 is set to the printing position.

The controller 21 commands the thermal head 12 to start printing. The thermal head 12 energizes the heating element array 12*a* to heat the inside of the printing area 30 so as to record a yellow image on the yellow thermal coloring layer 2*d* by one line. Similarly, the thermal head 12, in synchronism with conveyance of the recording paper 2, records the yellow image line by line.

When the conveyance amount from the start of printing reaches the target conveyance amount OP3, namely the print completion position, the controller 21 judges that the yellow image completes recording to the rear edge of the printing area 30 of the recording paper 2. The feed roller pair 10 rotates to convey the recording paper 2 at a predetermined amount, then the pulse motor 6 stops.

The yellow image completes recording, the controller 21 performs the return sequence. The platen roller 13 is lowered by the shift mechanism to be set away from the thermal head 12. The pulse motor 6 rotates in a forward direction again, making the supply roller 4 and the feed roller pair 10 rotate to convey the recording paper 2 in the supplying direction. In synchronism with this, the yellow fixation lamp 16 of the fixing device 15 is turned on to fix the yellow thermal coloring layer within the printing area 30 of the recording paper 2. The length measuring counter 21*a* measures the conveyance amount from the start of the pulse motor 6 to specify the position of the printing area.

The irradiance sensor 20 measures irradiance of the yellow fixation lamp 16 during the optical fixing operation. Based on a signal from the irradiance sensor 20, the controller 21 controls the rotation speed of the pulse motor 6 in order to maintain the fixation amount of the recording paper 2 regularly. Namely, the controller 21 decreases the conveyance speed of the recording paper 2 in case irradiance is lowered.

Figure 7:
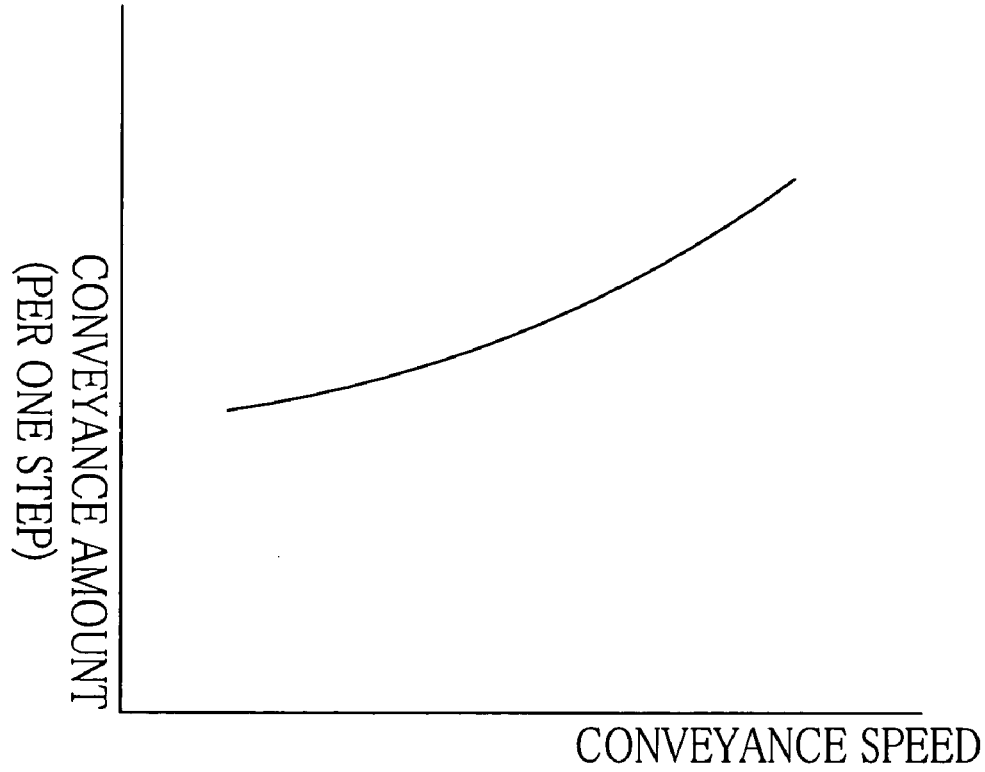
FIG. 7 is a graph which relates the conveyance speed of the recording paper to the conveyance amount for one step.
Figure 8:
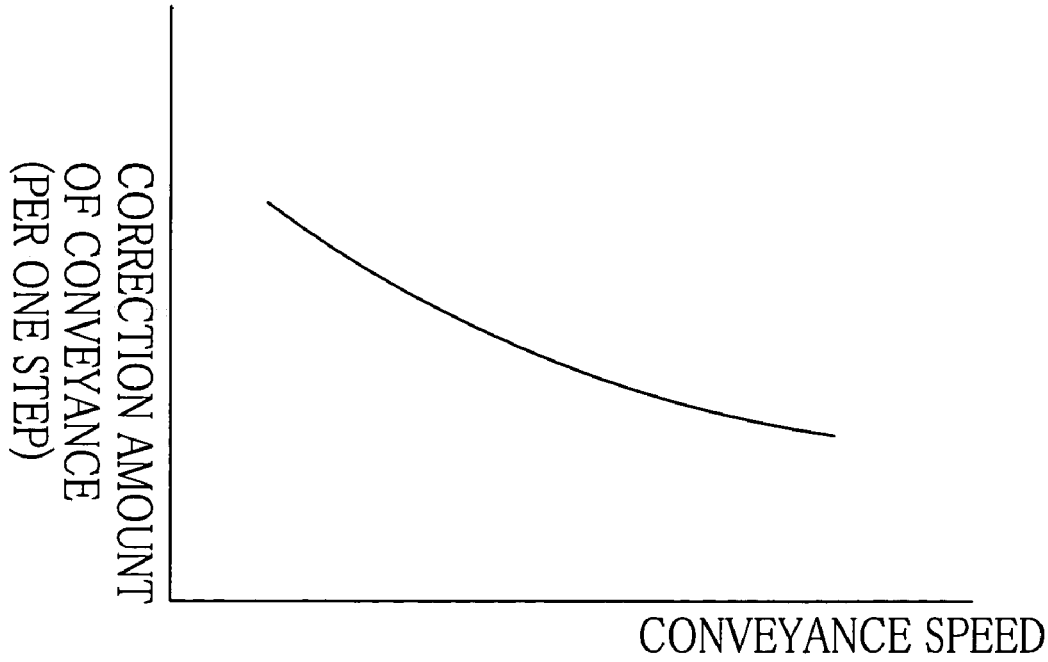
FIG. 8 is a graph which relates the conveyance speed of the recording paper to the correction amount.

As shown in FIG. 7, the conveyance amount per one drive pulse changes according to the conveyance speed of the recording paper 2. As the conveyance speed decreases, the conveyance amount for a single drive pulse is also reduced. FIG. 8 shows an example in which the conveyance speed is related to the correction amount based on the relation of FIG. 7. When the conveyance speed decreases, the correction amount gradually increases. Experiments are carried out to obtain a characteristic curve of FIG. 8. The characteristic curve is stored into a memory 21*b* of the controller 21 as a look-up table for correction of target conveyance amounts. Otherwise, the correction amount may be calculated, without using the look-up table, in terms of a functional formula which is derived from the characteristic curve of FIG. 8.

Based on the conveyance speed during the fixing operation, the controller 21 obtains the correction amount for each drive pulse and accumulates the plural levels of the correction amount. As a result, the correction amount of conveyance $\alpha 1$ is obtained. The correction amount of conveyance $\alpha 1$ adds to the target conveyance amount OP4 to get the target conveyance amount of OP4+$\alpha 1$. When the conveyance amount from the start of the return sequence reaches the target conveyance amount of OP4+$\alpha 1$, the return sequence ends to complete the yellow fixing.

The controller 21 restarts the print sequence. The target conveyance amount OP5 is set to convey the recording paper 2 in the printing start position so that the starting edge 30*a* of the printing area 30 is set exactly on the heating element 12*a* of the thermal head 12. The correction amount of conveyance $\alpha 1$ is obtained in yellow fixing operation to correct the target conveyance amount, so that the yellow thermal recording area coincides with the magenta thermal recording area in the print starting position. Owing to this, it is possible to correct fluctuation of the conveyance amount with a change of speed. Even if the conveyance speed changes with a change of irradiance, the printing position of the yellow image can be set equal to that of the magenta image.

Otherwise, it is possible to subtract the correction amount of conveyance from the target conveyance amount OP5 instead of adding the correction amount of conveyance $\alpha 1$ to the target conveyance amount OP4.

Continuously, the thermal printer conducts printing and fixing operation of the magenta image and corrects the conveyance amount. In the magenta fixing operation, similar to the yellow fixing operation, the conveyance speed is changed in accordance with a change of irradiance. As the conveyance speed changes, the target conveyance amount is corrected by the correction amount of conveyance $\alpha 2$. The magenta image can coincide with the cyan image in the printing position, then color registering failure is prevented from occurring.

The thermal printer conducts printing operation of the cyan image after printing the magenta image. After printing the cyan image, the recording paper 2 is moved through the outlet 25. Once the pulse motor 6 stops, the cutter 21 is activated to cut a cutting line 33. A sheet-shaped color print is cut off from the recording paper 2 and ejected. In this color print, the printing position of three primary images are coincident with one another.

In case the printing operation is conducted successively, the end 32 of the recording paper 2 is moved back to the ready position. Further, color images are printed thereon through the above-mentioned process. In case the printing operation is stopped, the recording paper 2 is wound into the roll paper 3. Coloring properties of the recording paper 2 are not affected by moisture, making it possible to obtain a full-color printing with an appropriate color degree.

The roll paper 3 is loaded into a roll chamber inside the color printer. It is also possible, however, to set the roll paper 3 to the color printer as loaded into the paper supply magazine. The paper supply magazine is provided with a supply roller, which makes rotation upon receiving the rotational force from the printer.

According to the above embodiment, the correction amount is obtained for each drive pulse by accumulation in accordance with successive changes of speed during the fixing operation. For some kinds of thermal printers, sampling of irradiation is conducted after a predetermined period since the fixing lamp was turned on. Since the fixing lamp increases irradiance in accordance with rise in temperature, a middle level of irradiation is chosen. In addition, in order to maintain this irradiation, the feedback control for the fixing lamp is conducted. Since irradiation does not fluctuate during the fixing operation, the recording paper 2 is conveyed at a constant speed.

The fixing lamp deteriorates in quality when the feedback control is performed. Therefore, irradiation for sampling also changes according to a usage period of the fixing lamp. The change of irradiation for sampling occurs as the conveyance speed of the recording paper 2 changes. In addition, as the conveyance speed of the yellow and the magenta fixing lamps have different properties from each other, the conveyance speed is different.

It is not necessary for the above color thermal printer to accumulate the correction amount for each drive pulse because the conveyance speed during the fixing operation does not fluctuate. Therefore, the correction amount of conveyance ($\alpha$) in the whole return sequence is taken on a vertical axis of FIG. 8.

The present invention may record more than four color images in which specific colors like gold and/or silver and the like are added to yellow, magenta and cyan. Further, two color images of black and gold are also possible, for instance.

The present invention is applicable for a thermal transfer printer of a dye sublimation type and a wax transfer type that uses a yellow, magenta, and cyan color ink sheet. These thermal transfer printers do not require the optical fixing device. Also, the present invention is applicable for the three-head one-pass type printer. Furthermore, it is also applicable for a color ink jet printer and other types of image forming apparatuses as well as for the color thermal printer. In addition, it is also applicable for a color printer for a cut sheet.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A color printer having at least one recording head and a feed roller pair, said recording head recording at least a first, a second, and a third primary color image within a recording area of recording material by frame sequential printing, said feed roller pair alternately conveying said recording material in a first direction and a second direction, said color printer comprising:

a detector for detecting a conveyance amount of said recording material by said feed roller pair;

a controller for performing a print sequence and a return sequence for said respective primary color images, and in said print sequence, said controller making said feed roller pair convey said recording material in said first direction, and when the conveyance amount from the start of conveyance of said recording material in said first direction reaches a first target conveyance amount, said controller driving said recording head to record one of said first to third primary color images within said recording area of said recording material, and in said return sequence, said controller making said feed roller pair convey said recording material in said second direction, and when the conveyance amount from the start of conveyance of said recording material in said second direction reaches a second target conveyance amount, said controller stopping its conveyance; and correction means for correcting said first target conveyance amount or said second target conveyance amount related to recording said second or said third primary color image, said correction means obtaining the correction amount of conveyance based on conveyance speed of said recording material in said return sequence.

2. A color printer as claimed in claim 1, wherein said first to third primary color images are a yellow, a magenta, and a cyan color images.

3. A color printer as claimed in claim 2, wherein said recording head is a thermal head, said recording material has a first, a second, and a third thermal coloring layers, said first thermal coloring layer is positioned uppermost, and develops yellow with said yellow image, said second thermal coloring layer is positioned second uppermost, and develops magenta with said magenta image, said third thermal coloring layer is positioned lowermost, and develops cyan with said cyan image, and said first and said second thermal coloring layers are fixed by an electromagnetic radiation having a prescribed wavelength range.

4. A color printer as claimed in claim 3, further comprising:

a fixing device for emitting irradiance having said particular wavelength range to said first and said second thermal coloring layers in said return sequence;

an irradiance measuring device for measuring irradiance of said electromagnetic radiation;

a memory for storing table data representing a relation of said conveyance speed and a correction amount per unit conveyance length; and said controller controlling said conveyance speed in said return sequence in accordance with said irradiance, wherein said correction means refers to said memory to correct said correction amount of conveyance.

5. A color printer as claimed in claim 4, wherein said controller maintains said conveyance speed in said print sequence, and in said return sequence, sets said conveyance speed at a successively adjusted level so as to keep said electromagnetic radiation at a regular amount and accumulates said correction amount for plural levels of said conveyance speed to obtain said correction amount of conveyance.

6. A color printing method for recording a first, a second, and a third primary color images within a printing area of recording material by frame sequential printing, said color printing method comprising steps of:

conveying said recording material in a first direction;

starting printing within said printing area of said recording material when the conveyance amount from the start of conveyance reaches a first target conveyance amount during the conveyance of said recording material in said first direction;

conveying said recording material in a second direction after completing recording of one of said first to said third primary color images within said recording area of said recording material;

stopping conveyance of said recording material when the conveyance amount from the start of conveyance reaches a second target conveyance amount during the conveyance of said recording material in said second direction; and obtaining the correction amount of conveyance based on the conveyance speed during the conveyance of said recording material in said second direction to correct said first or said second target conveyance amount so as to record said second or said third primary color image.

7. A color printing method as claimed in claim 6, wherein said first to said third primary color images are a yellow, a magenta, and a cyan images, and said recording material has a yellow, a magenta, and a cyan thermal coloring layers, said yellow thermal coloring layer is positioned uppermost, and develops yellow when small thermal energy is applied, said magenta thermal coloring layer is positioned second uppermost, and develops magenta when middle thermal energy is applied, the cyan thermal coloring layer is positioned lowermost, and develops cyan when large thermal energy is applied, and coloring ability of said yellow and said magenta thermal coloring layers is destroyed by electromagnetic radiation having a prescribed wavelength range.

8. A color printing method as claimed in claim 7, wherein said conveyance speed is maintained while said recording material is conveyed in said first direction, and said conveyance speed is set at a successively adjusted level while said recording material is conveyed in said second direction so as to regulate the amount of electromagnetic radiation, and the correction amount to plural levels of conveyance speed is accumulated to obtain the correction amount of conveyance.

9. A color printer having a recording head, said recording head printing at least a first, a second and a third primary color images within a printing area of recording material by frame sequential printing, said color printer comprising:

a feeder for conveying said recording material;

a detector for detecting the conveyance amount of said recording material by said feeder;

a controller for starting printing within said printing area of said recording material when the conveyance amount of said recording material reaches a target conveyance amount; and correction means for correcting said target conveyance amount related to printing said first or said second primary color image, said correction means obtaining the correction amount of conveyance to correct said target conveyance amount based on a fluctuation of conveyance speed of said recording material by said feeder.

10. A color printer having at least one recording head and a feed roller pair, said recording head recording at least a first and a second color images within a recording area of recording material by frame sequential printing, said feed roller pair alternately conveying said recording material in a first direction and a second direction, said color printer comprising:

a detector for detecting a conveyance amount of said recording material by said feed roller pair;

a controller for performing a print sequence and a return sequence for said respective color images, and in said print sequence, said controller making said feed roller pair convey said recording material in said first direction, and when the conveyance amount from the start of conveyance of said recording material in said first direction reaches a first target conveyance amount, said controller driving said recording head to record one of said first and said second color images within said recording area of said recording material, and in said return sequence, said controller making said feed roller pair convey said recording material in said second direction, and when the conveyance amount from the start of conveyance of said recording material in said second direction reaches a second target conveyance amount, said controller stopping its conveyance; and correction means for correcting said first target conveyance amount or said second target conveyance amount related to recording said second color image, said correction means obtaining the correction amount of conveyance based on conveyance speed of said recording material in said return sequence.

* * * * *